US008104520B2

(12) United States Patent
Ours et al.

(10) Patent No.: US 8,104,520 B2
(45) Date of Patent: Jan. 31, 2012

(54) GENTLE HANDLING HOPPER AND SCRUNCHED BAG FOR FILLING AND FORMING A TRANSPORTABLE CONTAINER

(75) Inventors: Dave Ours, Marshall, MI (US); Sharon Juntunen, Portage, MI (US); Stanley Davis, Maple Grove, MN (US); Clark Kreider, Rogers, MN (US)

(73) Assignee: Kellogg Company, Battle Creek, MI (US)

( * ) Notice: Subject to any disclaimer, the term of this patent is extended or adjusted under 35 U.S.C. 154(b) by 462 days.

(21) Appl. No.: 12/482,826

(22) Filed: Jun. 11, 2009

(65) Prior Publication Data

US 2009/0308486 A1 Dec. 17, 2009

Related U.S. Application Data

(60) Provisional application No. 61/060,492, filed on Jun. 11, 2008.

(51) Int. Cl.
*B65B 1/04* (2006.01)
*B65B 13/02* (2006.01)

(52) U.S. Cl. ..... 141/10; 141/316; 141/317; 53/139.1; 53/399

(58) Field of Classification Search ..... 141/10, 141/114, 314–317; 53/139.1, 399
See application file for complete search history.

(56) References Cited

U.S. PATENT DOCUMENTS

| | | | |
|---|---|---|---|
| 98,848 | A | 1/1870 | Chanute et al. |
| 47,944 | A | 2/1874 | Keen et al. |
| 887,242 | A | 5/1908 | Frank |
| 1,061,394 | A | 5/1913 | Michener, Jr. |
| 1,466,724 | A | 9/1923 | McMeans |
| 1,474,625 | A | 11/1923 | Eckert |
| 1,590,086 | A | 6/1926 | Day et al. |
| 1,649,362 | A | 11/1927 | Nagel |
| 1,730,295 | A | 10/1929 | Reuther |
| 1,777,224 | A | 9/1930 | Reuther |

(Continued)

FOREIGN PATENT DOCUMENTS

| | | | |
|---|---|---|---|
| DE | 574994 | C | 4/1933 |

(Continued)

OTHER PUBLICATIONS

International Search Report Dated Oct. 6, 2009, 5 Pages.

*Primary Examiner* — Timothy L Maust
(74) *Attorney, Agent, or Firm* — Dickinson Wright PLLC

(57) ABSTRACT

A method of forming a transportable container of bulk goods begins by placing the distributing end of a hopper over the open top of a bunched bag. Bulk goods are dispensed from the distributing end of the hopper through the open top of the bag to establish a level of bulk goods in the bag. The hopper moves vertically relative to the closed base of the bag during the dispensing of bulk goods from the distributing end of the hopper to maintain vertical spacing between the distributing end of the hopper and the level of bulk goods in the bag. A hopper fill level is maintained in the hopper during the dispensing of bulk goods from the hopper. An outer wrap is spirally wrapped around the bag while filling the bag to form the transportable container. The outer wrap is maintained near the level of bulk goods in the bag.

28 Claims, 7 Drawing Sheets

U.S. PATENT DOCUMENTS

| | | | |
|---|---|---|---|
| 1,834,472 | A | 12/1931 | Oliver |
| 1,861,147 | A | 5/1932 | Steimel |
| 1,926,986 | A | 9/1933 | Angier |
| 1,992,046 | A | 2/1935 | Shomaker |
| 2,011,978 | A | 8/1935 | Marks |
| 2,013,215 | A | 9/1935 | Langenberg |
| 2,074,595 | A | 3/1937 | Shackelford |
| 2,419,330 | A | 4/1947 | Anderson |
| 2,676,739 | A | 4/1954 | Nettekoven et al. |
| 2,683,522 | A | 7/1954 | Mercier |
| 2,702,625 | A | 2/1955 | Hapman |
| 2,765,816 | A | 10/1956 | Carter |
| 2,863,475 | A | 12/1958 | Lau |
| 3,066,817 | A | 12/1962 | Bradshaw et al. |
| 3,260,352 | A | 7/1966 | Sheridan |
| 3,374,599 | A | 3/1968 | Sanders |
| 3,533,454 | A | 10/1970 | Tinsley |
| 3,570,749 | A | 3/1971 | Sato et al. |
| 3,578,183 | A | 5/1971 | Larger |
| 3,593,484 | A | 7/1971 | Dussich |
| 3,626,654 | A | 12/1971 | Hoffler et al. |
| 3,688,893 | A | 9/1972 | Wallace, Jr. |
| 3,707,127 | A | 12/1972 | Palfey |
| 3,743,078 | A | 7/1973 | Pittoreau |
| 3,758,410 | A | 9/1973 | Liu |
| 3,776,435 | A | 12/1973 | Smith |
| 3,778,962 | A | 12/1973 | James |
| 3,785,410 | A | 1/1974 | Carter |
| 3,847,290 | A | 11/1974 | Suykens |
| 3,848,728 | A | 11/1974 | Leibrick et al. |
| 3,879,917 | A | 4/1975 | Bassendale et al. |
| 3,902,303 | A | 9/1975 | King |
| 3,906,591 | A | 9/1975 | Boiradi |
| 3,928,940 | A | 12/1975 | Fagniart |
| 3,943,988 | A | 3/1976 | Consorti |
| 3,944,070 | A | 3/1976 | Cardwell et al. |
| 3,949,536 | A | 4/1976 | Chevalier |
| 3,951,462 | A | 4/1976 | De Francisci |
| 3,961,459 | A | 6/1976 | Wolske |
| 3,968,626 | A | 7/1976 | Hobbs |
| 4,007,694 | A | 2/1977 | Fowler et al. |
| 4,042,035 | A | 8/1977 | Boyer |
| 4,050,219 | A | 9/1977 | Higgins |
| 4,074,507 | A | 2/1978 | Ruf et al. |
| 4,078,358 | A | 3/1978 | Henderson |
| 4,101,292 | A | 7/1978 | Hogan, II |
| 4,106,261 | A | 8/1978 | Greenawalt |
| 4,113,146 | A | 9/1978 | Williamson |
| 4,129,054 | A | 12/1978 | Fazis |
| 4,136,501 | A | 1/1979 | Connolly |
| 4,149,755 | A | 4/1979 | Handleman et al. |
| 4,182,386 | A | 1/1980 | Alack |
| 4,205,930 | A | 6/1980 | Handleman et al. |
| 4,219,054 | A | 8/1980 | Carter et al. |
| 4,223,061 | A | 9/1980 | Michaels |
| 4,227,609 | A | 10/1980 | Gunther et al. |
| 4,234,273 | A | 11/1980 | Handleman et al. |
| 4,249,639 | A | 2/1981 | Vukovic |
| 4,249,839 | A | 2/1981 | Vance |
| 4,253,507 | A | 3/1981 | Williamson |
| 4,268,204 | A | 5/1981 | Stellfox et al. |
| 4,299,076 | A | 11/1981 | Humphrey |
| 4,309,861 | A | 1/1982 | Karpisek |
| 4,333,561 | A | 6/1982 | Schlegel |
| 4,339,040 | A | 7/1982 | Peil et al. |
| 4,355,714 | A | 10/1982 | Chever |
| 4,360,996 | A | 11/1982 | Rutter |
| 4,409,776 | A | 10/1983 | Usui |
| 4,434,603 | A | 3/1984 | Beumer |
| 4,456,119 | A | 6/1984 | in't Hout et al. |
| 4,500,001 | A | 2/1985 | Daniels |
| 4,546,593 | A | 10/1985 | Lasscock |
| 4,546,598 | A | 10/1985 | Karpisek |
| 4,604,854 | A | 8/1986 | Andreas |
| 4,607,476 | A | 8/1986 | Fulton, Jr. |
| 4,617,683 | A | 10/1986 | Christoff |
| 4,648,432 | A | 3/1987 | Mechalas |
| 4,671,043 | A | 6/1987 | Forni et al. |
| 4,706,441 | A | 11/1987 | Chervalier |
| 4,734,292 | A | 3/1988 | Gerardus Van Boxtel |
| 4,738,578 | A | 4/1988 | Johnston |
| 4,753,060 | A | 6/1988 | Furukawa |
| 4,763,955 | A | 8/1988 | Justice |
| 4,770,287 | A | 9/1988 | Glowatzki |
| 4,779,402 | A | 10/1988 | Duynhoven et al. |
| 4,781,475 | A | 11/1988 | LaFleur |
| 4,827,697 | A | 5/1989 | Ross |
| 4,860,884 | A | 8/1989 | Kostrewa |
| 4,883,167 | A | 11/1989 | Shibata |
| D305,374 | S | 1/1990 | Sahm, Jr. |
| 4,890,722 | A | 1/1990 | Gough |
| 4,909,017 | A | 3/1990 | McMahon et al. |
| 4,930,632 | A | 6/1990 | Eckert et al. |
| 5,016,761 | A | 5/1991 | Stoddard et al. |
| 5,025,925 | A | 6/1991 | Wiklund |
| 5,042,235 | A | 8/1991 | Hannen et al. |
| 5,046,603 | A | 9/1991 | Odenthal |
| 5,117,750 | A | 6/1992 | Mosier, II et al. |
| 5,125,785 | A | 6/1992 | Langen et al. |
| 5,143,203 | A | 9/1992 | Hinner |
| 5,203,142 | A | 4/1993 | Kollross |
| 5,230,689 | A | 7/1993 | Derby |
| 5,241,804 | A | 9/1993 | Tsuruta et al. |
| 5,336,417 | A | 8/1994 | Hannum |
| 5,353,936 | A | 10/1994 | Dockstader et al. |
| 5,354,569 | A | 10/1994 | Brown et al. |
| 5,382,117 | A | 1/1995 | Rings et al. |
| 5,474,111 | A | 12/1995 | Williamson et al. |
| 5,477,658 | A | 12/1995 | Berger et al. |
| 5,501,254 | A | 3/1996 | Bjorklund |
| 5,507,859 | A | 4/1996 | Kaiser |
| 5,544,472 | A | 8/1996 | Koskinen et al. |
| 5,564,878 | A | 10/1996 | Kay |
| 5,566,530 | A | 10/1996 | Johnstone et al. |
| 5,567,048 | A | 10/1996 | Hammonds |
| 5,573,044 | A | 11/1996 | Mechalas |
| 5,598,387 | A | 1/1997 | Pohl |
| 5,598,684 | A | 2/1997 | Aarts |
| 5,637,183 | A | 6/1997 | Borner |
| 5,641,057 | A | 6/1997 | Chorlton |
| 5,651,447 | A | 7/1997 | Huang |
| 5,678,387 | A | 10/1997 | Aarts |
| 5,687,551 | A | 11/1997 | Mustain et al. |
| 5,697,408 | A | 12/1997 | Reeves |
| 5,699,915 | A | 12/1997 | Berger et al. |
| 5,702,034 | A | 12/1997 | Semenenko |
| 5,769,206 | A | 6/1998 | Miyazawa et al. |
| 5,787,945 | A | 8/1998 | Riemersma |
| 5,807,054 | A | 9/1998 | Seymour |
| 5,809,744 | A | 9/1998 | Villines et al. |
| 5,809,922 | A | 9/1998 | Nelson |
| 5,848,683 | A | 12/1998 | Seymour |
| 5,887,409 | A | 3/1999 | Leal Pereira Da Silva |
| 5,944,455 | A | 8/1999 | Wilhelm |
| 5,953,888 | A | 9/1999 | Martin-Cocher et al. |
| 5,960,927 | A | 10/1999 | Bahr |
| 5,967,579 | A | 10/1999 | Hebert |
| RE36,467 | E | 12/1999 | Seymour |
| 6,009,993 | A | 1/2000 | Turcheck, Jr. |
| 6,012,266 | A | 1/2000 | Koskinen et al. |
| 6,032,439 | A | 3/2000 | Birkenfeld et al. |
| 6,032,786 | A | 3/2000 | Svensson |
| 6,036,408 | A | 3/2000 | Wilhelm et al. |
| 6,131,766 | A | 10/2000 | King et al. |
| 6,138,723 | A | 10/2000 | Wagner |
| 6,164,453 | A | 12/2000 | Perkins |
| 6,178,720 | B1 | 1/2001 | Schianchi |
| 6,205,750 | B1 | 3/2001 | Koskinen et al. |
| D440,362 | S | 4/2001 | Thornberg |
| 6,219,998 | B1 | 4/2001 | Demming et al. |
| 6,254,519 | B1 | 7/2001 | Toshima |
| 6,289,636 | B1 | 9/2001 | White et al. |
| 6,299,354 | B2 | 10/2001 | Nickell et al. |
| 6,312,151 | B1 | 11/2001 | Pendleton |
| 6,324,459 | B1 | 11/2001 | Jung |
| 6,324,818 | B1 | 12/2001 | Morness et al. |
| 6,334,527 | B1 | 1/2002 | Kitamura |

| | | | | |
|---|---|---|---|---|
| 6,343,459 | B1 | 2/2002 | Seaward et al. | |
| 6,371,644 | B1 | 4/2002 | Forman | |
| 6,382,108 | B1 | 5/2002 | Stanek et al. | |
| 6,393,804 | B1 | 5/2002 | Ausnit | |
| 6,415,927 | B1 | 7/2002 | Stone et al. | |
| 6,470,654 | B1 | 10/2002 | Lachenmeier et al. | |
| 6,494,324 | B2 | 12/2002 | Ours et al. | |
| 6,560,947 | B2 | 5/2003 | Kasel | |
| 6,575,629 | B1 | 6/2003 | Perkins | |
| 6,594,970 | B1 | 7/2003 | Hyne et al. | |
| 6,647,701 | B2 | 11/2003 | Rettich | |
| 6,843,283 | B2 | 1/2005 | Dietrich | |
| 6,845,600 | B2 | 1/2005 | Hannen et al. | |
| 6,865,865 | B2 | 3/2005 | Hannen et al. | |
| 6,880,311 | B2 | 4/2005 | Winkler | |
| 6,892,768 | B1 | 5/2005 | Ours et al. | |
| 6,918,225 | B2 | 7/2005 | Ours et al. | |
| 6,935,385 | B2 | 8/2005 | Ours et al. | |
| 6,945,015 | B2 | 9/2005 | Ours et al. | |
| 6,979,166 | B2 | 12/2005 | Ours et al. | |
| 7,040,076 | B2 | 5/2006 | Lachenmeier et al. | |
| 7,055,293 | B2 | 6/2006 | Ours et al. | |
| 7,080,730 | B2 | 7/2006 | Ours et al. | |
| 7,174,924 | B2 | 2/2007 | Ours et al. | |
| 7,284,360 | B2 | 10/2007 | Cary et al. | |
| 7,536,840 | B2 | 5/2009 | Ours et al. | |
| 7,921,624 | B2 * | 4/2011 | Ours et al. | 53/399 |
| 2001/0008567 | A1 | 7/2001 | Burkhardt | |
| 2002/0130016 | A1 | 9/2002 | Scholz | |
| 2002/0191869 | A1 | 12/2002 | Stewart et al. | |
| 2003/0038055 | A1 | 2/2003 | Ours et al. | |
| 2003/0057129 | A1 | 3/2003 | Ours et al. | |
| 2004/0081374 | A1 | 4/2004 | Richardson, Jr. et al. | |
| 2005/0204709 | A1 | 9/2005 | Berger et al. | |

FOREIGN PATENT DOCUMENTS

| | | | |
|---|---|---|---|
| DE | 621624 | | 11/1935 |
| DE | 3006623 | A1 | 8/1981 |
| DE | 3340322 | A1 | 5/1985 |
| DE | 4124911 | | 1/1993 |
| DE | 4439970 | A1 | 5/1996 |
| DE | 29503132 | U1 | 7/1996 |
| EP | 0122864 | A1 | 10/1984 |
| EP | 0765829 | A1 | 4/1997 |
| EP | 09222640 | A1 | 6/1999 |
| EP | 0943560 | A1 | 9/1999 |
| FR | 2600973 | | 1/1988 |
| GB | 876754 | | 9/1961 |
| GB | 2154975 | A | 9/1985 |
| JP | 54143261 | A | 8/1979 |
| WO | 8600594 | | 1/1986 |
| WO | 0144051 | | 6/2001 |

* cited by examiner

GENTLE HANDLING HOPPER AND SCRUNCHED BAG FOR FILLING AND FORMING A TRANSPORTABLE CONTAINER

CROSS REFERENCE TO RELATED APPLICATION

This application claims the benefit of U.S. Provisional Patent Application Ser. No. 61/060,492 for GENTLE HANDLING HOPPER AND SCRUNCHED BAG FOR FILLING AND FORMING A TRANSPORTABLE CONTAINER, filed on Jun. 11, 2008, which is hereby incorporated by reference in its entirety.

BACKGROUND OF THE INVENTION

1. Field of the Invention

The present invention relates to a method of filling a transportable container of bulk goods, particularly to a method using a gentle handling hopper and scrunched bag to reduce the amount of breakage in the bulk goods disposed in the transportable container.

2. Description of the Prior Art

Systems for packaging a plurality of bulk goods in transportable containers are known in the art. Typical transportable containers utilized for the transport of bulk goods are inefficient, do not have a very large volume, and often require a large amount of manual labor to be used in filling and handling of the transportable container. Typically, the filling of these containers requires the bulk goods to be dropped large distances which may result in breakage in the bulk goods.

An example of one such system is disclosed in U.S. Pat. No. 6,176,276 to Maunder et al. The '276 patent discloses a device for feeding a granular material from an upstream source, such as a conveyor, to a downstream container. The hopper has a downwardly tapered section which tapers inwardly to a delivery chute which has a flared lower end terminating in a radial flange. An adjustable annulus is defined between a frusto-conical member and the hopper wall near the inwardly tapered section of the hopper to control the flow from the downwardly tapered section to the delivery chute. An adjustable radial outlet is defined between the flange of the chute and the annulus. A jet of compressed air is supplied to the delivery chute via an air pipe to generate an air stream to entrain the material which falls through the annulus and shoots the material from the chute.

Another such system known in the art is disclosed in U.S. Pat. No. 5,697,408 to Reeves. The '408 patent discloses a telescopic tube that extends downwardly into a container to fill the container. The volume of the telescopic tube varies based on the position of the tube end. A top hat valve member and valve seat are moved vertically in the storage container so that the particles don't have as far to drop from the telescopic tube to the storage container.

Another such system known in the art is disclosed in U.S. Pat. No. 4,546,598 to Karpisek. The '598 patent discloses a wrapping apparatus having an expandable carrier or frame being supported on a transporter. The carrier comprises a rectangular tubular member that is telescopic. A bracket or arm extends from each corner of the tubular member for the wrap to be applied to. The wrap is a bag having a closed base and an open end. The carrier is placed on a puckering device or loader where the bag of wrap material is loaded onto the carrier. Each of the brackets engage a belt that drives the wrap onto the carrier. After the wrap is loaded onto the carrier, the carrier is telescopically expanded to a diameter larger than that of the load of previously stacked goods in which it will be placed upon. The loaded carrier is then transferred and positioned over a pallet with the load of stacked goods. The carrier is lowered such that the open end is lowered over the stacked goods. The closed base engages the top of the load as the carrier is lowered, causing the wrap to strip from the carrier as it descends downwardly, thereby depositing the wrap over the load of goods. Upon release from the stretching forces applied by the carrier, the stretched bag will commence to contract to achieve its prestretched condition.

SUMMARY OF THE INVENTION

The present invention relates to a method of forming a transportable container of bulk goods from a gentle handling hopper and scrunched or bunched bag. A bag having an open top and a closed base is bunched onto an intermediate carrier. The intermediate carrier is secured to a packaging system, with the open top of the bag being disposed adjacent the distributing end of a hopper and the closed base of the bag being positioned vertically below the open top. The distributing end of the hopper is placed over the bag to create a vertical space between the distributing end and closed base. Bulk goods are distributed into the hopper opening of the hopper to establish a hopper fill level. The bulk goods are dispensed from the distributing end of the hopper through the open top of the bag into the closed base of the bag to establish a level of bulk goods in the bag. The hopper moves vertically during the dispensing of the bulk goods to maintain the vertical space between the distributing end of the hopper and the level of bulk goods in the bag. A hopper fill level is maintained in the hopper during the dispensing of bulk goods from the hopper and concurrent with the moving of the hopper in response to the level of bulk goods in the bag. The intermediate carrier moves relative to the closed base of the bag to distribute the bag from the intermediate carrier as the level of bulk goods in the bag increases. An outer wrap is spirally wrapped around the bag while filling the bag to form the transportable container. The outer wrap is maintained near the level of bulk goods in the bag.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
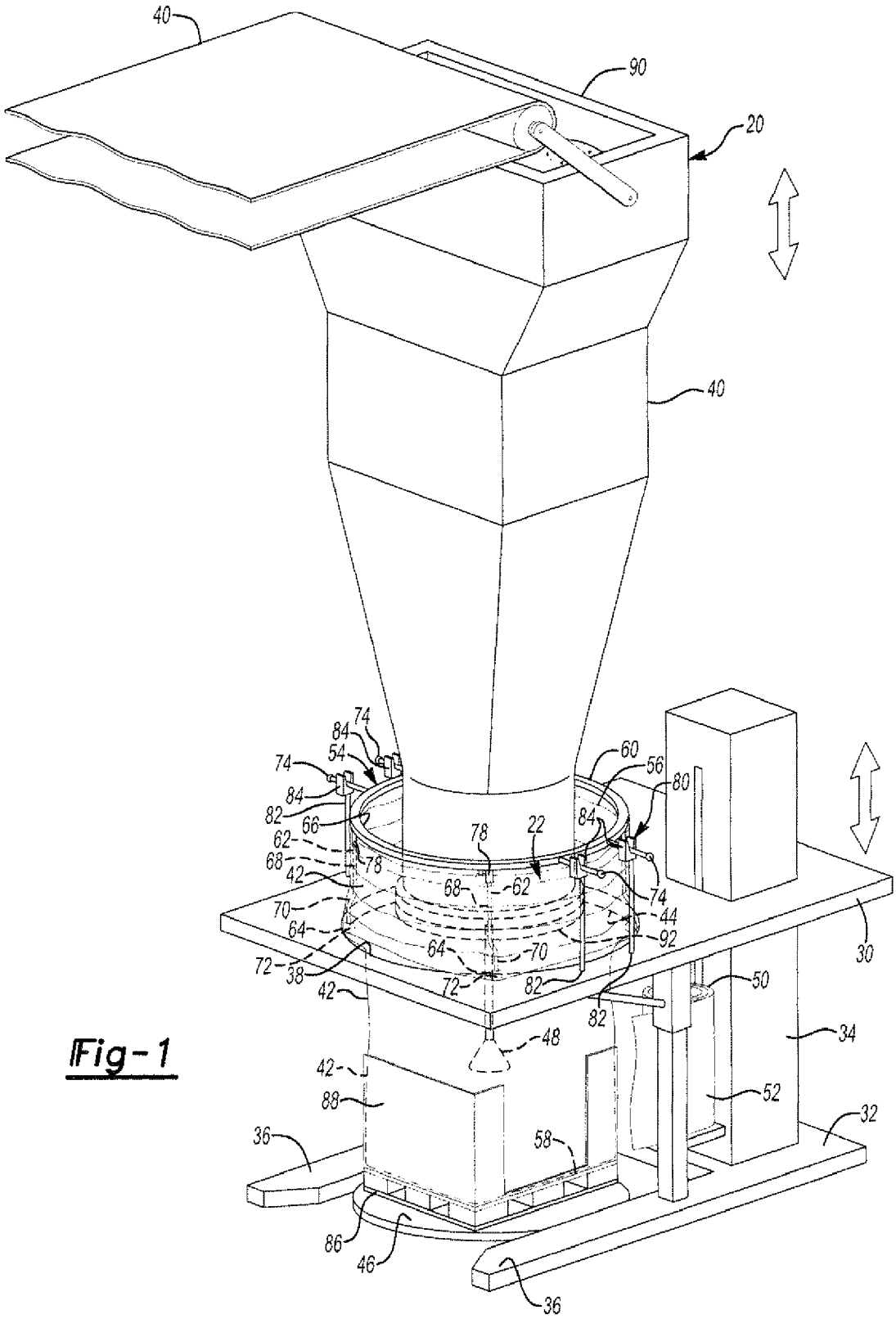
FIG. 1 is a perspective view of a packaging system according to the present invention with a flexible bag of the present invention in an open position prior to filling and wrapping.

Throughout the present specification and claims the phrase "bulk goods" is used as a shorthand version of the wide range of products that can be packaged utilizing the present invention. The present invention finds utilization in packaging any material that can be bulk packaged. These items can encompass large bulk packaged pieces as well as very small bulk packaged pieces. Examples of smaller bulk goods include, but are not limited to, the following: agricultural products like seeds, rice, grains, vegetables, fruits, chemical products like fine chemicals, pharmaceuticals, raw chemicals, fertilizers, plastics like plastic resin pellets, plastic parts, rejected plastic parts, machined plastic parts, cereals and cereal products such as wheat, a variety of machined parts of all sorts, wood products like wood chips, landscaping material, peat moss, dirt, sand, gravel, rocks and cement. The present invention also finds utilization in bulk packaging of larger bulk goods including, but not limited to: prepared foods, partially processed foods like frozen fish, frozen chicken, other frozen meats and meat products, manufactured items like textiles, clothing, footwear, toys like plastic toys, plastic half parts, metallic parts, soft toys, stuffed animals, and other toys and toy products. All of these types of materials and similar bulk packaged materials are intended to be encompassed in the present specification and claims by this phrase.

Referring to the Figures, wherein like numerals indicate like or corresponding parts throughout the several views, a gentle handling hopper 20 and scrunched bag system 22 for filling and forming a transportable container 24 of bulk goods 26 are generally shown.

While the gentle handling hopper 20 and scrunched bag system 22 may be adapted to work with any number of packaging systems 28, the exemplary embodiment of the present invention will be explained in reference to the exemplary packaging system 28 described below.

Figure 2:
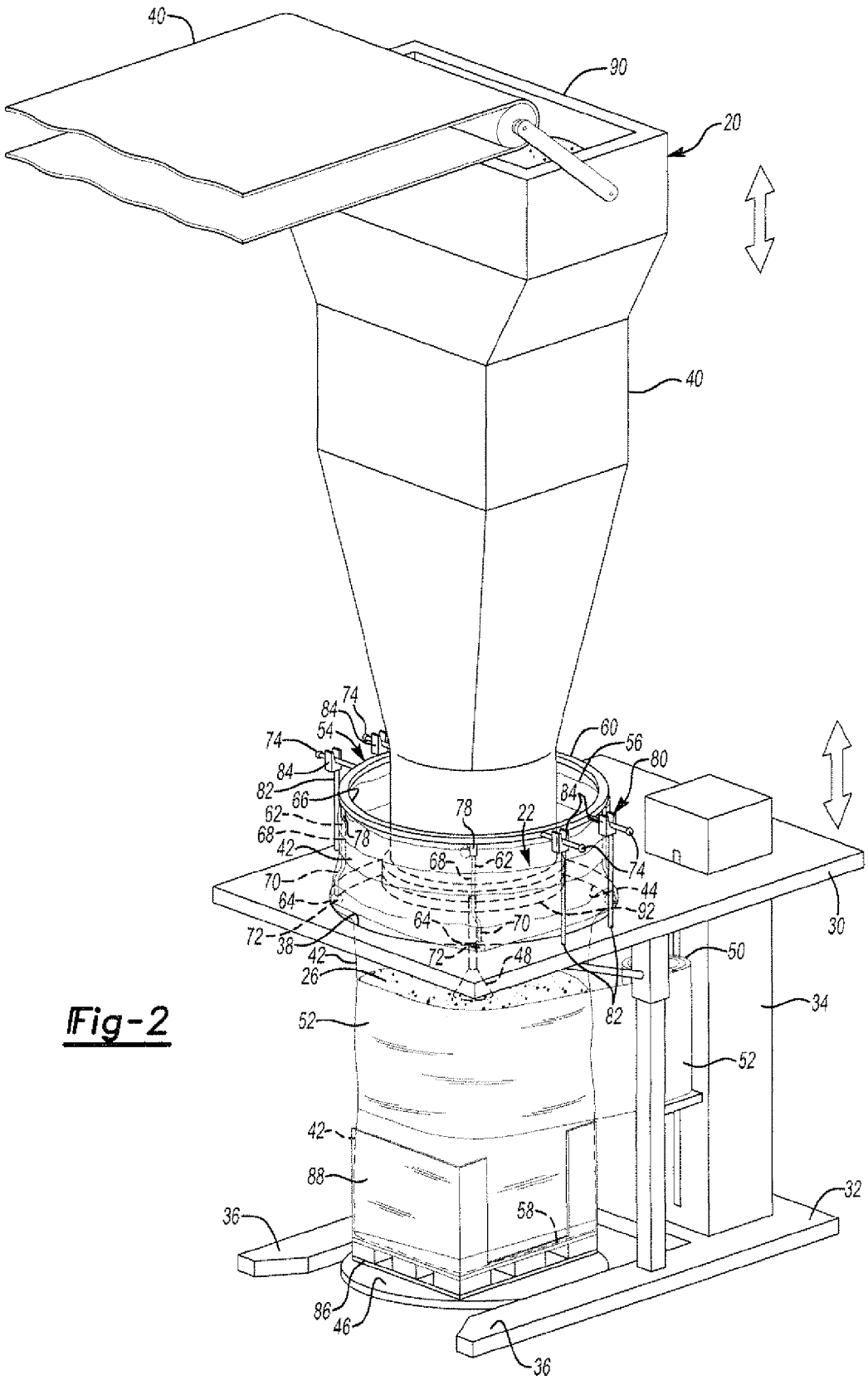
FIG. 2 is a perspective view of the system of FIG. 1 during the filling and wrapping stages.
Figure 3:
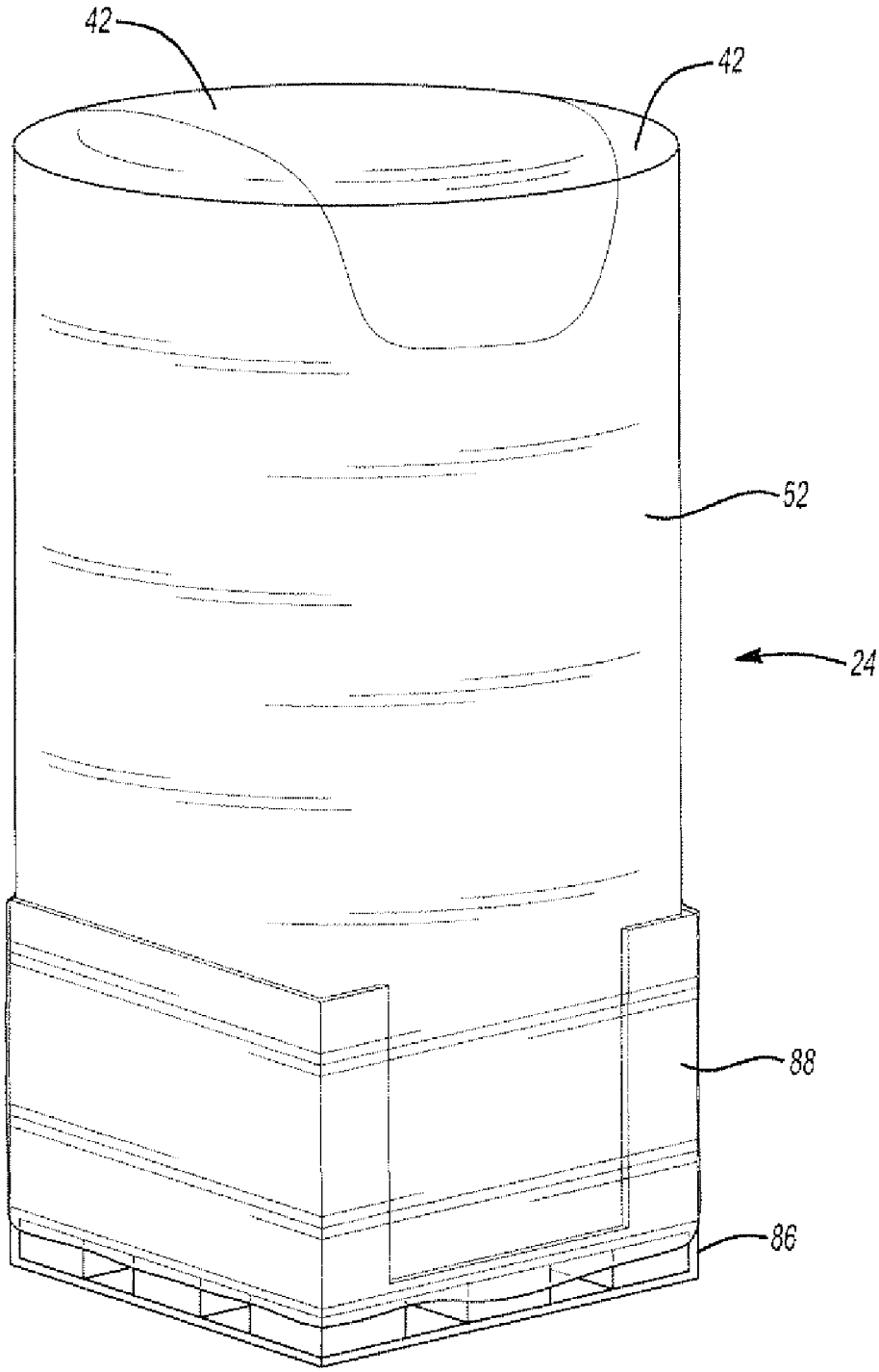
FIG. 3 is a perspective view of the transportable container in a fully wrapped stage.

As shown in FIGS. 1 and 2, the exemplary packaging system 28 includes a frame having an upper support 30 spaced from a frame base 32. At least one support column 34 extends between the frame base 32 and upper support 30. The frame base 32 includes a pair of base legs 36. The upper support 30, the frame base 32 or both may be vertically movable along the support column 34. The upper support 30 includes a support opening 38 through which the bulk goods 26 may be fed from a feed source 40 into the bag 42 to form the transportable container 24 as shown in FIG. 3. An upper turntable 44 is mounted within the upper support 30 of the packaging system 28. A lower turntable 46 is mounted within the frame base 32 of the packaging system 28. Both the lower turntable 46 and upper turntable 44 are rotatable, and rotation of the lower turntable 46 and upper turntable 44 may be synchronized such that they rotate in unison. The synchronized rotation of the of the upper and lower turntables 44, 46 allows for the even distribution of bulk goods 26 in the transportable container 24.

The packaging system 28 may include a fill sensor 48 to monitor and measure the level of bulk goods 26 in the bag 42. The measured level of bulk goods 26 in the bag 42 may be used in connection with the various features and functions of the packaging system 28. For example, the level of bulk goods 26 in the bag 42 may be used to determine the flow rate of bulks goods into the bag 42 from the feed source 40, the movement of the upper support 30 or frame base 32 to accommodate more bulk goods 26, and the rotation of the upper and lower turntables 44, 46 to distribute the bulk goods 26 evenly into the bag 42 which forms the transportable container 24. The fill sensor 48 may be an ultrasonic transmitter and receiver, or any other sensor known in the art.

The packaging system 28 may comprise a conventional stretch wrapping device 50 such as, for example, a Lantech Q series semi-automatic wrapper. The stretch wrapping device 50 further includes a wrap head having a roll of outer wrap 52 secured on a wrap head base. The outer wrap 52 is preferably a stretch wrap having a high cling factor, but the outer wrap 52 may be any of a variety of stretch wrap films known in the art. The wrap head is vertically moveable along a guide rod that runs parallel to the support column 34. The movement of the wrap head may be controlled by a motor or any other movement control mechanism known in the art.

Initially, the bulk goods 26 are disposed into flexible bag 42 from the feed source 40. The fill sensor 48 is utilized to detect the height or level of the bulk goods 26 within the flexible bag 42. As the flexible bag 42 is filled with bulk goods 26 the upper turntable 44 and lower turntable 46 are rotated at a speed and the wrap head is moved vertically upward such that the outer wrap 52 is always maintained at a level slightly below or near the level of bulk goods 26 in the bag 42. In an alternative embodiment, the outer wrap 52 can be rotated around a stationary bag 42. As the bag 42 is filled, the fill sensor 48 is slowly withdrawn from flexible bag 42. The system can be adjusted to provide overlapping layers of outer wrap 52 spaced apart from 0.5 to 15 inches.

The outer wrap 52 generates hoop forces which apply a gentle squeeze to the bulk goods 26, helping to stabilize the bulk goods 26. The hoop forces stabilize the bulk goods 26 by promoting controllable contact between the elements of the bulk goods 26 being loaded into the bag 42 of the transportable container 24, thereby promoting bridging between the components of the bulk goods 26. For example, when the hulk goods 26 being loaded are a bulk cereal in puff or flake form, hoop forces promote bridging between cereal pieces, thereby reducing the relative motion between the pieces and immobilizing the cereal within the bag 42. By adjusting the extent to which the outer wrap 52 is applied to the bag 42, hoop forces can be tailored to the type of bulk goods 26 being inserted in the transportable container 24. Hoop forces allow for a very compact and rigid transportable container 24, which does not allow the bulk goods 26 to shift or get crushed within the transportable container 24.

The exemplary embodiment includes a scrunched bag system 22 having an intermediate carrier 54 for holding a flexible bag 42 in an open and scrunched or bunched position. The flexible bag 42 includes an open top 56 and a closed base 58 to form the transportable container 24 of bulk goods 26. The flexible bag 42 is either circular or square in cross-section to define a circular or square open top 56. The closed base 58 can be formed into the bag 42 or the bag 42 can be a continuous tubular roll wherein the closed base 58 is formed by folding over the tube, bunching the tube up, or by twisting and tying off a length of the tube which later could be used as a pour spout during subsequent unloading of the bulk goods 26. The bag 42 is preferably a gusseted bag 42 and can be formed from any suitable material for the bulk goods 26 disposed in the bag 42 of the transportable container 24, such as for example, low density polyethylene, high density polyethylene, a food grade polymer, or nylon.

Figure 4:
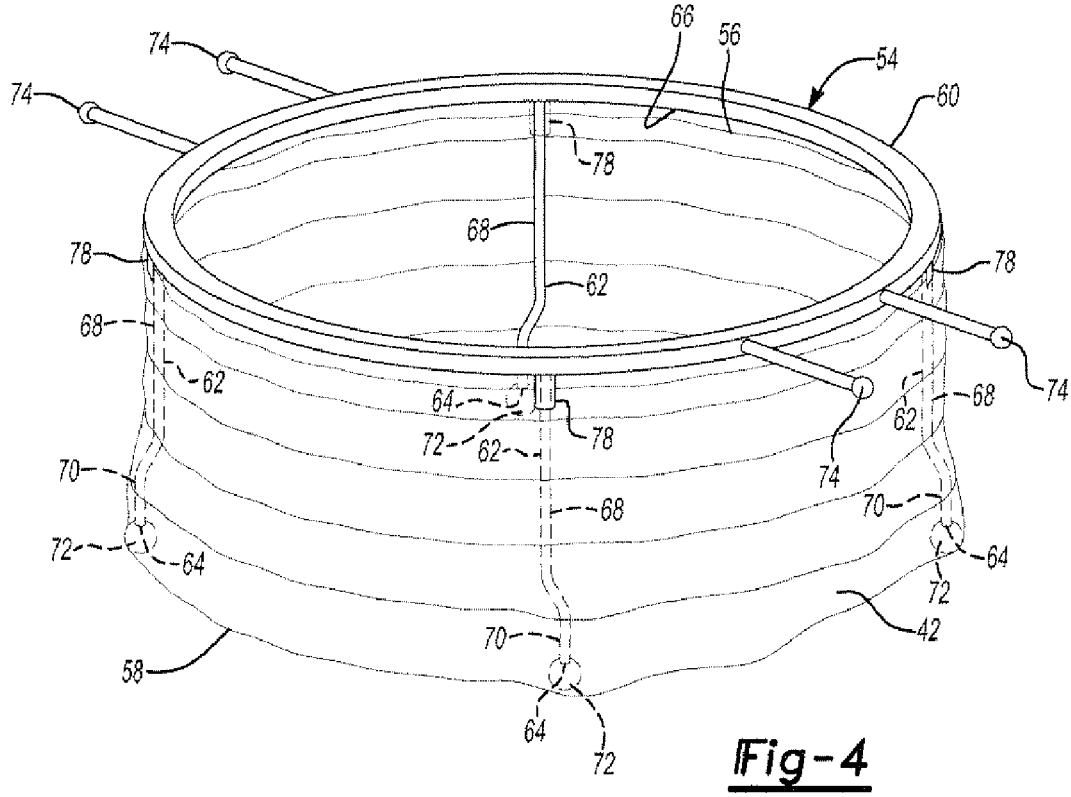
FIG. 4 is a perspective view of an exemplary intermediate carrier according to the subject invention.
Figure 5:
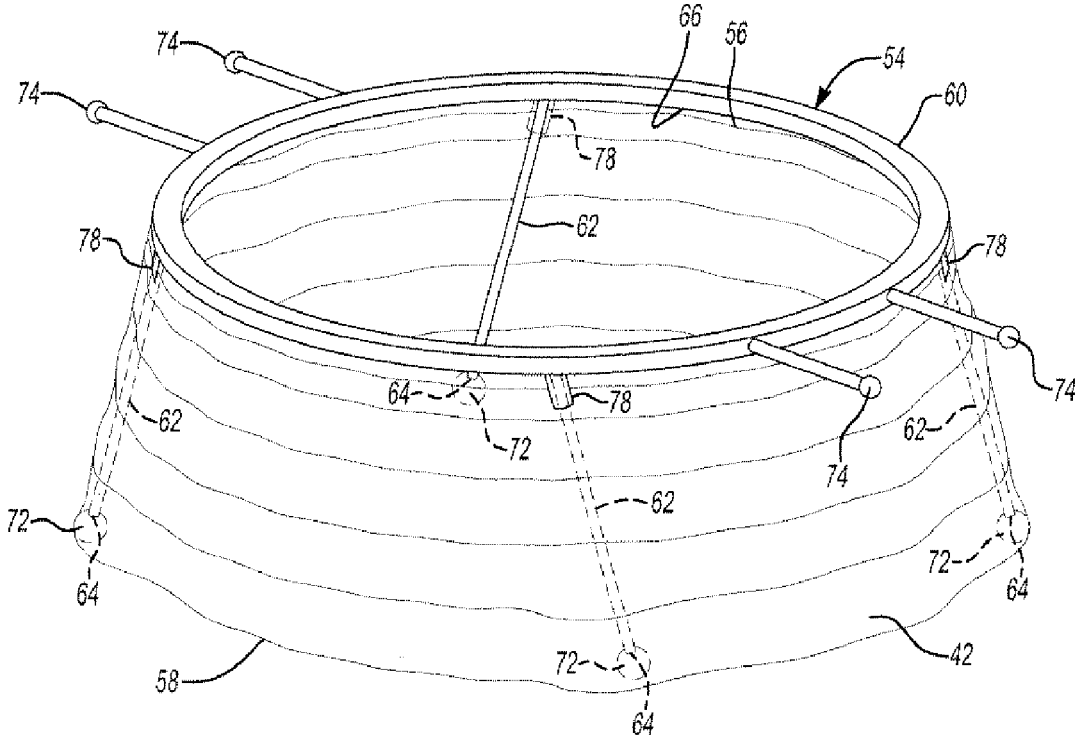
FIG. 5 is a perspective view of an exemplary intermediate carrier according to the subject invention.

The intermediate carrier 54 has a carrier base 60 and a plurality of carrier arms 62 extending from the carrier base 60 to an arm end 64. In the exemplary embodiment, the carrier base 60 is circular and defines a carrier opening 66. While the carrier base 60 is circular in the exemplary embodiment, the carrier base 60 may be any shape known in the art, including but not limited to, square and rectangular. In the exemplary embodiment, the intermediate carrier 54 has four carrier arms 62, but the intermediate carrier 54 may have any number of carrier arms 62 necessary. As shown in FIG. 4, the carrier arms 62 have a first arm portion 68 that extends perpendicularly from the base of the intermediate carrier 54 and a second arm portion 70 that is angled radially outward to the arm end 64. Each of the arm ends 64 may include a cap portion 72 to assist with guiding the bag 42 onto the intermediate carrier 54. The cap portion 72 pushes outwardly against the inside surface of the flexible bag 42 creating a force on the bag 42 to secure the bag 42 onto the intermediate carrier 54. In the exemplary embodiment, the cap portion 72 is a spherical cap, but it may be any shape known in the art. In an alternative embodiment, as shown in FIG. 5, each of the carrier arms 62 may extend angularly from the base to the arm end 64 that is disposed radially outwardly from the base of the intermediate carrier 54.

The intermediate carrier 54 may include a plurality of support arms 74 that extend radially from the base. The support arms 74 are used to engage the packaging system 28 and secure the intermediate carrier 54 to the packaging system 28.

The bag 42 used to create the transportable container 24 is fed onto the intermediate carrier 54 with a feeder. The feeder is independent of the packaging system 28. Prior to placement on the packaging system 28, the intermediate carrier 54 is placed onto the feeder. The open top 56 of the bag 42 is placed around the plurality of carrier arms 62 and secured to the intermediate carrier 54 by the use of at least one support clip 78. In the exemplary embodiment, the support clip 78 is disposed on the carrier base 60 adjacent at least of one of the carrier arms 62. The feeder controls the flow of the bag 42 onto the intermediate carrier 54. The feeder has a plurality of rollers and/or belts to uniformly control the feed of the bag 42 onto the intermediate carrier 54. Uniformly feeding the bag 42 onto the intermediate carriers 54 allows for bag 42 to be uniformly dispersed from the carrier when forming the transportable container 24. Uniform disbursement of the bag 42 from the intermediate carrier 54 is useful in maintaining a desired shape for the transportable container 24.

Once the bag 42 is placed onto the intermediate carrier 54, the intermediate carrier 54 is transported to the packaging system 28. This can be done by a human operator, a robot or other mechanical means. In the exemplary embodiment, the intermediate carrier 54 is placed on a top hat piece 80 that extends from the upper turntable 44 of the upper support 30. The top hat piece 80 is secured to the upper turntable 44 such that when the upper turntable 44 rotates, the top hat piece 80 is rotatable therewith. In the alternative embodiment, the top hat piece 80 may be secured to the upper support 30 and remains stationary. The top hat piece 80 includes a plurality of hat arms 82 that extend upwardly from the upper turntable 44, with each of the hat arms 82 defining a support notch 84 adjacent each of the hat arm ends. Each of the support notches 84 support a support arm 74 of the intermediate carrier 54 to secure the intermediate carrier 54 to the upper turntable 44 of the packaging system 28. The carrier arms 62 extend downwardly from the top hat portion and through the support opening 38 such that the bag 42 will be disposed from the intermediate carrier 54 through the support opening 38 as bulk goods 26 are fed from the feed source 40 into the bag 42. In an alternative embodiment, the hat arms 82 may extend downwardly from the upper support 30 or upper turntable 44, In the exemplary embodiment, the intermediate carrier 54 is secured to the packaging system 28 such that the scrunched bag 42 disposed on the intermediate carrier 54 is placed through the support opening 38 of the upper support 30 of the packaging system 28. The open top 56 is disposed adjacent the feed source 40, and the closed base 58 of the bag 42 is placed in an initial former 88 or slip sheet that rests on a transportable container support 86 or pallet. The initial former 88 and transportable container support 86 may be independent of each other or a singular unit. In the exemplary embodiment the transportable container support 86 is a pallet that is used in transporting the transportable container 24, but may be any other transportable container support 86 known in the art. In the exemplary embodiment the initial former 88 is a slip sheet that is placed on the transportable container support 86, but the initial former 88 may be any other initial former 88 known in the art.

The transportable container support 86 is placed on and movable with the lower turntable 46 and frame base 32. The frame base 32 may move vertically and the lower turntable 46 may be rotatable within the frame base 32. While the upper and lower turntables 44, 46 may be stationary, in the exemplary embodiment, the upper and lower turntables 44, 46 are rotatable, preferably synchronized in rotation to provide an even distribution of bulk goods 26 in the transportable container 24.

In the exemplary embodiment, bulk goods 26 are fed into the open top 56 of bag 42 through the carrier opening 66 by the feed source 40. The feed source 40 may be a conveyor, hopper 20 or any other source for feeding bulk goods 26 into a transportable container 24.

In the exemplary embodiment, as the bulk goods 26 are fed into the bag 42 to increase the level of bulk goods 26 in the bag 42, the upper support 30, top hat piece 80, and the secured intermediate carrier 54 move upwardly in response to the level of bulk goods 26 in the bag 42. The weight of the bulk goods 26 in the bag 42 will keep the closed base 58 of the bag 42 secured in the initial former 88 and transportable container support 86 disposed on the frame base 32 while the bag 42 is distributed from the intermediate carrier 54. Since the bag 42 has been uniformly distributed onto the carrier, the bag 42 will be distributed uniformly from the carrier arms 62 as the bag 42 is pulled away from the intermediate carrier 54. As previously discussed, the cap portion 72 of the intermediate carrier 54 pushes outwardly against the inside surface of the flexible bag 42 to create a force on the bag 42 that secures the bag 42 onto the intermediate carrier 54. The weight of the bulks goods in the bag 42 will cause the bag 42 to be pulled away from the cap portion 72 of the intermediate carrier 54 to create the transportable container 24. The uniform distribution of the bag 42 from the intermediate carrier 54 will allow the transportable container 24 to hold its shape. The transportable container 24 can be any shape known in the art, including, but not limited to round and square.

As shown in FIG. 1, the outer wrap 52 is initially wrapped spirally about the support, initial former 88 and a portion of the bag 42 in which the bulk good 26 have been fed. As shown in FIG. 2, as the level of bulk goods 26 increases in the bag 42, the outer wrap 52 is spirally wrapped by the stretch wrapping device 50 at a predetermined level below the level of bulk goods 26 to form the transportable container 24. The bulk goods 26 will initially conform to the shape of the initial former 88 and the shape of the bag 42 being fed from the intermediate carrier 54. As the bag 42 is filled with bulk goods 26, the closed base 58 of the bag 42 moves vertically relative to the open top 56 in response to the fill level of the bulk goods 26 in the bag 42. In an exemplary embodiment, the open top 56 moves upwardly relative to the stationary closed base 58 in response to the fill level of the bulk goods 26 in the bag 42. In another embodiment, the closed base 58 moves downwardly relative to the stationary open top 56 in response to the fill level of the bulk goods 26 in the bag 42. As the bag 42 is filled with bulk goods 26, additional portions of stretch wrap are disposed around the bag 42. The stretch wrap is maintained at a level below the fill level of the bulk goods 26 to maintain the shape of the transportable container 24 and to squeeze the bag 42 and lock together the bulk goods 26 disposed in the bag 42. In the exemplary embodiment, the stretch wrap is an outer wrap 52 from a stretch wrap roll that is disposed spirally about the transporter base and the bag 42, but any stretch wrap known in the art, including but not limited to a stretch bag 42 and heat shrink film, may be used.

The use of a scrunched bag 42 will limit the distance the bulk goods 26 must fall, and thus breakage, from the feed source 40 into the transportable container 24. The scrunched bag 42 allows for the feed source 40 to be maintained a constant distance from the fill level of the bulk goods 26 in the transportable container 24.

In another exemplary embodiment, the frame base 32 is vertically movable. During the initial stages of filling the bag 42, the lower turntable 46 is placed at a position adjacent to upper support 30. The closed base 58 of the bag 42 rests on the transportable container support 86 and initial former 88 that is placed on and movable with the lower turntable 46 and frame base 32. As the bag 42 fills, the frame base 32 along with the closed base 58 of the bag 42 are moved in a downward direction to accommodate additional bulk goods 26.

The weight of the bulk good 26 will keep the closed base 58 of the bag 42 on the transportable container support 86 while the bag 42 is distributed from the intermediate carrier 54. Since the bag 42 has been uniformly distributed onto the carrier, the bag 42 will be distributed uniformly from the carrier arms 62 as the bag 42 is pulled away from the carrier. As previously discussed, the cap portion 72 of the intermediate carrier 54 pushes outwardly against the inside surface of the flexible bag 42 to create a force on the bag 42 that secures the bag 42 onto the intermediate carrier 54. The weight of the bulks goods in the bag 42 will cause the bag 42 to be pulled away from the cap portion 72 of the intermediate carrier 54 to create the transportable container 24. The uniform distribution of the bag 42 from the intermediate carrier 54 will allow the transportable container 24 to hold its shape. The transportable container 24 can be any shape known in the art, including, but not limited to round and square.

Movement of the lower turntable 46 can be accomplished by any of a variety of mechanisms including scissors platform legs, hydraulic pistons, pneumatic pistons, or a geared mechanism. As the level of bulk goods 26 increases in the bag 42 and the frame base 32 is moved vertically downwardly to accommodate additional bulk goods 26, the outer wrap 52 is spirally wrapped by the stretch wrapping device 50 at a predetermined level below the level of bulk goods 26 to form the transportable container 24.

Figure 6:
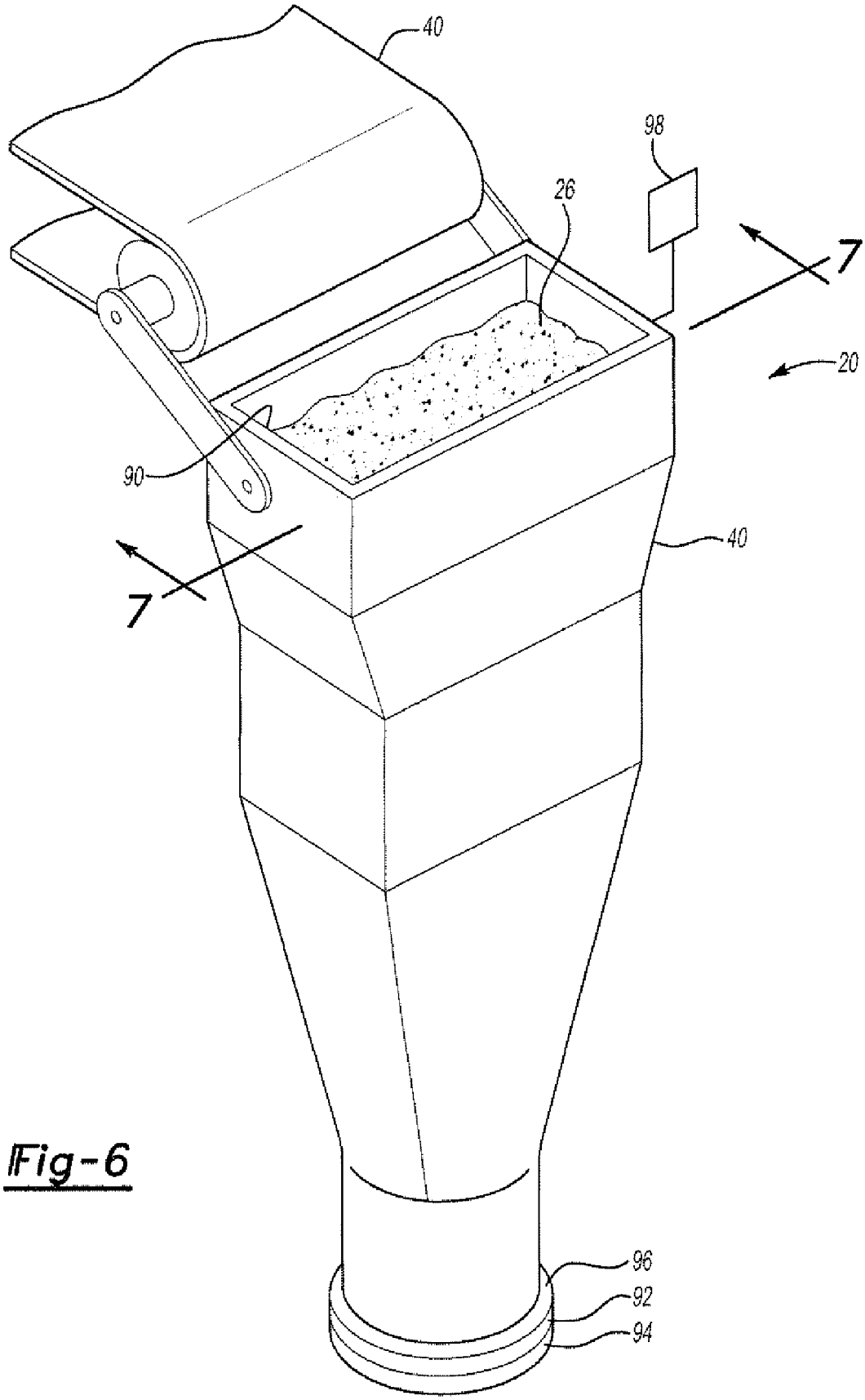
FIG. 6 is a perspective view of a gentle handling hopper according to the subject invention.
Figure 7:
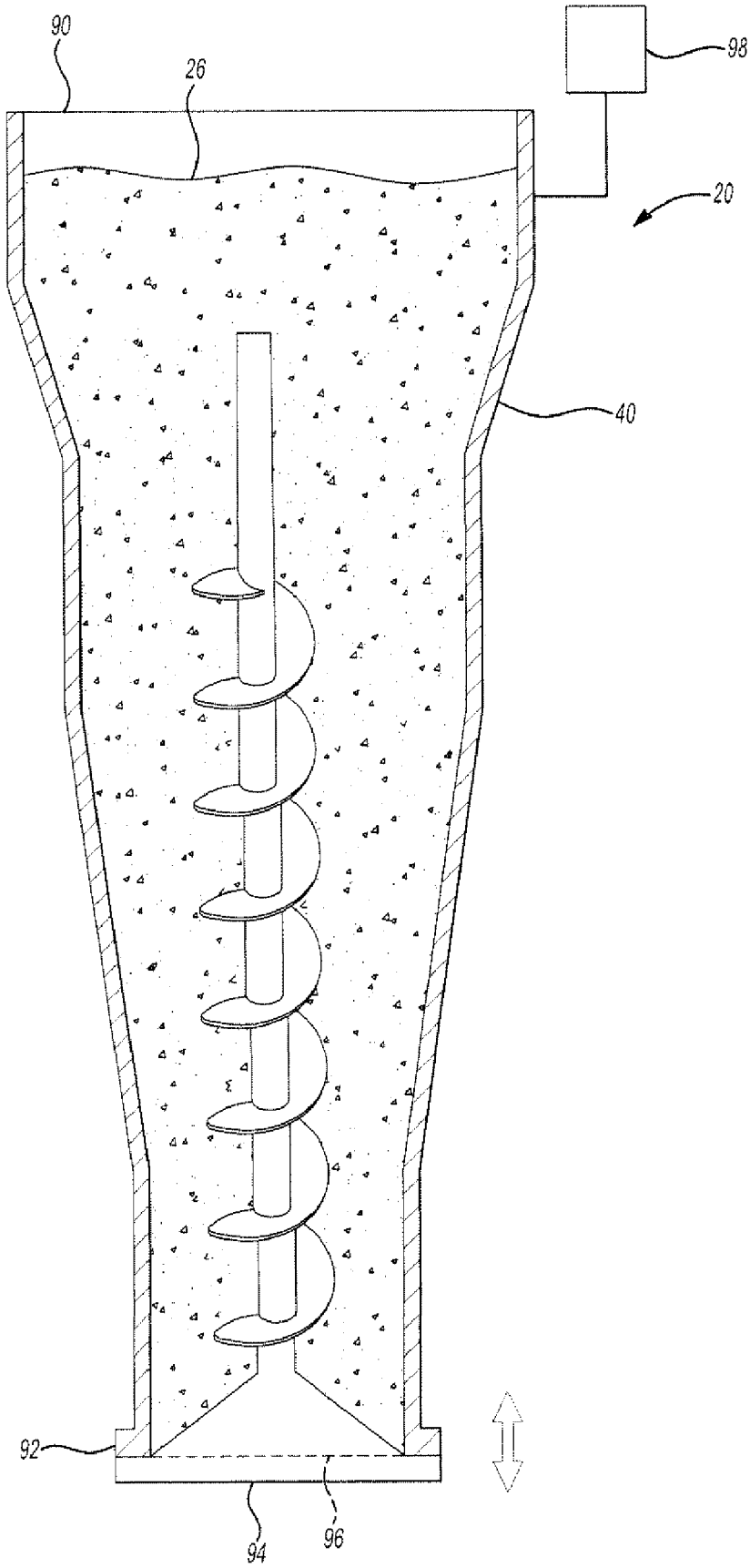
FIG. 7 is a cross-sectional view of the gentle handling hopper along line 6-6 of FIG. 6.
Figure 8:
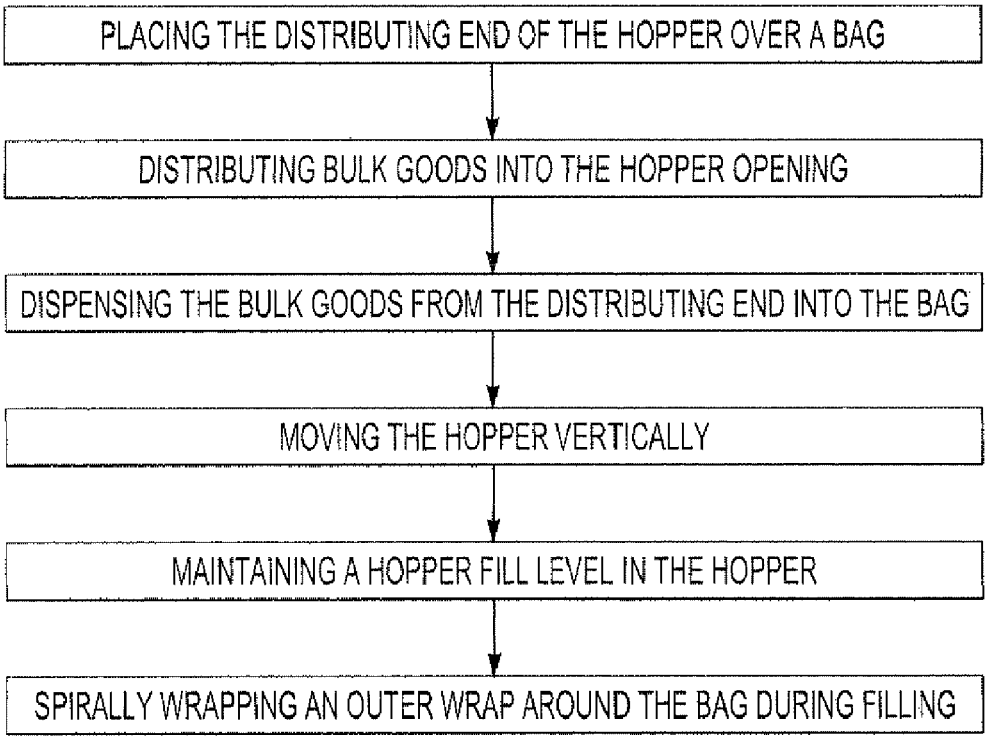
FIG. 8 is a flow chart showing an exemplary method of forming a transportable container according to the present invention.
Figure 9:
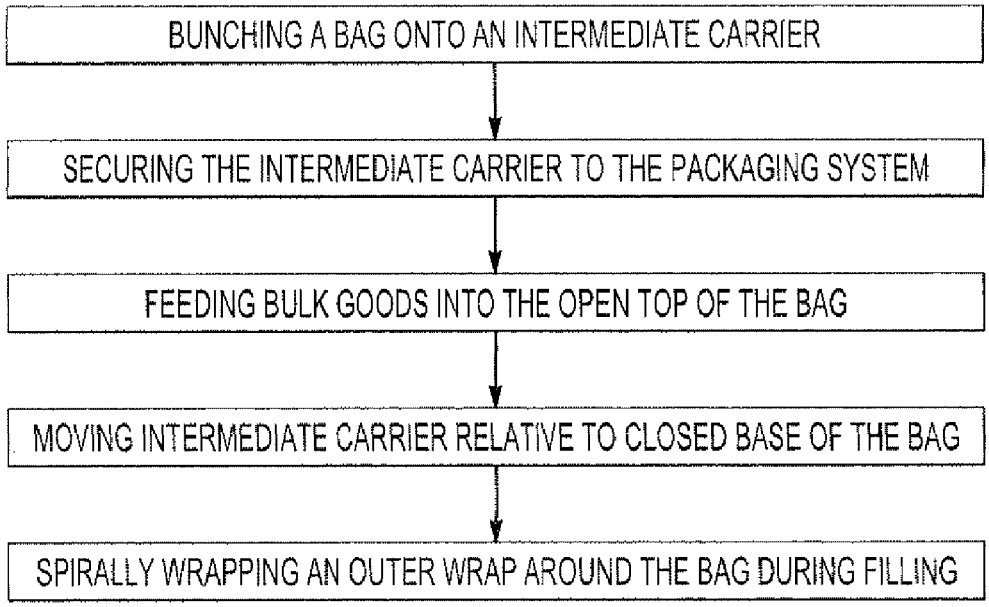
FIG. 9 is a flow chart showing another exemplary method of forming a transportable container according to the present invention.

As shown in FIGS. 1 and 2, and particularly FIGS. 5 and 6, the feed source 40 may be a gentle handling hopper 20 for filling the bag 42 and creating the transportable container 24. The gentle handling hopper 20 may be used with a bag 42 disposed on an intermediate carrier 54 as previously discussed, with a just a bag 42, or any other system known in the art. In an exemplary embodiment, the gentle handling hopper 20 is disposed at a conveyor end and has a fixed volume. In an alternative embodiment, the hopper 20 may have a telescopic tube to vary the volume of the hopper 20. The hopper 20 minimizes the vertical drop from the conveyor to the bag 42 to minimize breakage of the bulk goods 26. The hopper 20 is vertically movable so that the hopper 20 is continuously positioned over the open top 56 of the bag 42. Based on the level of bulk goods 26 in the transportable container 24, the hopper 20 will feed bulk goods 26 from a feed source 40, such as, a conveyor to the transportable container 24.

The hopper 20 may be stationary or movable. The hopper 20 may move upward in response to the level of bulk goods 26 in the bag 42 as determined by the fill sensor 48. As the level of bulk goods 26 rises, the hopper 20 will move upwardly with the upper support 30. In the preferred embodiment, the movement of the hopper 20 and the upper support 30 will be synchronized such that the hopper 20 will remain a constant distance from the fill level of bulk goods 26 in the bag 42. The conveyor is movable along both a horizontal and vertical path to maintain the position of the hopper 20 over the open top 56 of the bag 42. Preferably, the hopper 20 is maintained in a position over the center of the open top 56, which allows for a more even distribution of bulk goods 26 into the bag 42.

In another exemplary embodiment, the hopper 20 remains stationary as the frame base 32 moves downwardly in response to the level of the bulk goods 26 in the transportable container 24. In this embodiment, during the initial stages of filling the bag 42, the frame base 32 is placed at a position adjacent to the upper turntable 44. The closed base 58 of the bag 42 rests on the transportable container support 86 and initial former 88 that is placed on and movable with the lower turntable 46 and frame base 32. As the bag 42 fills, the frame base 32 along with the closed base 58 of the bag 42 are moved in a downward direction to accommodate additional bulk goods 26 from the stationary hopper 20. The weight of the bulk goods 26 will keep the closed base 58 of the bag 42 on the support pallet while the bag 42 moves downwardly.

The hopper 20 includes a hopper opening 90 to receive the bulk goods 26 from the feed source 40. In the exemplary embodiment, the feed source 40 is a conveyor and the bulk goods 26 are fed from the conveyor end into the hopper opening 90. The cross-section of the hopper opening 90 is generally rectangular but may be any shape known in the art. In a first hopper 20 portion, the cross section of the hopper 20 necks down gradually to a second hopper 20 portion. The second hopper 20 portion is generally rectangular in cross-section, but may be any shape known in the art, and extends vertically to a third hopper 20 portion. The third hopper 20 portion transitions from the generally rectangular cross-sectioned second portion to a fourth hopper 20 portion having a generally circular cross-section but may be any shape known in the art. The fourth hopper 20 portion extends vertically downward from the third hopper 20 portion to a hopper 20 distributing end 92. The distributing end 92 is positioned over the open top 56 of the bag 42 at a predetermined distance above the level of bulk goods 26.

The hopper 20 is operated by maintaining the bulk goods 26 at a relatively high level within the hopper 20. The bulk goods 26 do not have to fall far from the conveyor end into the hopper opening 90. The movement of the bulk goods 26 through the hopper 20 is controlled such that the bulk goods 26 fed from the distributing end 92 of the hopper 20 into the bag 42 of the transportable container 24 have a shorter distance to fall. The hopper 20 breaks the fall of the bulk goods 26 from the conveyor end to the bag 42 into two short falls as opposed to one larger fall. The two shorter falls minimizes the breakage of the bulk goods 26.

The hopper 20 includes a modulating valve 94 disposed at the distributing end 92 to adjust the flow of the bulk goods 26 from the hopper 20 into the bag 42. A cone, plate, or screw may also be used to adjust the flow of the bulk goods 26 from the hopper 20. The modulating valve 94 moves closer to and further away from a valve seat 96 to keep the level of the bulk goods 26 at a desired level within the hopper 20. The modulating valve 94 may further be rotatable based the bulk goods 26 being distributed from the distribution end 92 of the hopper 20. If the level of bulk goods 26 within the hopper 20 is above the desired level the top hat valve will move away from the valve seat 96 to distribute the bulk goods 26 to the bag 42 at an increased rate thus lowering the level of the bulk goods 26 in the hopper 20 such that the bulk goods 26 will not spill out of the hopper opening 90. If the level of bulk goods 26 within the hopper 20 is below the desired level the top hat valve will move towards the valve seat 96 to distribute the bulk goods 26 into the bag 42 at a decreased rate thus the raising the level of the bulk goods 26 in the hopper 20 to minimize the distance the bulk goods 26 must fall from the feed source 40. As a result, the bulk goods 26 fall a shorter distance from the feed source 40 into the hopper 20 and gently and gradually travel to the distributing end 92 of the hopper 20 to be distributed into the bag 42 to form the transportable container 24. Additionally, the valve 94 helps distribute the bulk goods 26 within the bag 42 to maintain an even fill and to have a flat top, thus increasing the amount of bulk goods 26 in the transportable container 24.

The modulating valve 94 may further include a bulk goods distributor. In the exemplary embodiment, the bulk goods distributor is at least one chute that aids in the distribution or preferential flow of the bulk goods 26 from the distributing end 92 of the hopper 20, but the bulk goods distributor may be any mechanism known in the art of preferential flow of bulk goods 26. The bulk goods distributor may be flat, can include side walls, be rounded, or any other configuration based on the desired flow and the type of bulk goods 26 being distributed. The bulk goods distributor may be incorporated into the design of the modulating valve 94 or it may be a separate and distinct unit that can be attached to the modulating valve 94. The bulk goods distributor allows for distribution of bulks goods to desired locations of the transportable container 24, which aids in the forming of square or rectangular shaped transportable containers 24. The bulk goods distributor allows for more flow of bulk goods 26 to the corners of the square or rectangular transportable container 24 to improve stability and shape consistency of the square or rectangular loads. The bulk goods distributor allows for the flow of bulk goods 26 from the distributing end 92 of the hopper 20 to be controlled and directed to desired portions of the transportable container 24 to aid in the shaping of the transportable container 24.

The hopper 20 includes a hopper sensor 98 to measure the hopper fill level of bulk goods 26 in the hopper 20. The hopper sensor 98 is in communication with the modulating valve 94 to control the rate of distribution of the bulk goods 26 and the hopper fill level in the hopper 20. The hopper sensor 98 monitors the amount of bulk goods 26 in the hopper 20 and regulates the modulating valve 94, cone, plate, or screw to maintain the bulk goods 26 height or hopper fill level in the hopper 20.

The packaging system 28 preferably includes a control panel to permit an operator to control various functions such as stop, start, rotation speed and wrap head movement speed. Such controls are known in the art. The packaging system 28 further includes conventional controls to maintain proper fill level, outer wrap 52 force, and sequencing. The relationship of these parameters is constantly monitored and automatically adjusted by means known in the art. The hopper 20 and feed source 40 may be in communication with the fill sensor 48 of the packaging system 28 that monitors the level of bulk goods 26 in the bag 42 of the transportable container 24 via the control panel. For example, the fill sensor 48 may communicate with the hopper 20 to control, by shutting off or turning on, the flow of bulk goods 26 from the distributing end 92 of the hopper 20. Further, the fill sensor 48 may communicate with the feed source 40 to control, by shutting off or turning on, the flow of bulk goods 26 from the feed source 40 into the hopper 20.

The hopper 20 improves the quality of the bulk goods 26 by decreasing the breakage that occurs. The hopper 20 will reduce the vertical drop bulk goods 26 will experience. The bulk goods 26 have a shorter drop from the conveyor to the hopper 20. The bulk goods 26 have a softer landing in the hopper 20 by landing on other bulk goods 26 already in the hopper 20. The bulk goods 26 then gradually flow through the hopper 20 and there is a small drop from the distributing end 92 of the hopper 20 to the bag 42 that is being filled to form the transportable container 24. The hopper 20 is easier to clean due to the limited moving parts inside the food stream and easy to change over between products.

The outer wrap 52 is initially wrapped spirally about the support, initial former 88 and a portion of the bag 42 in which the bulk good 26 have been fed. As the level of bulk goods 26 increases in the bag 42, the outer wrap 52 is spirally wrapped by the stretch wrapping device 50 at a predetermined level below the level of bulk goods 26 to form the transportable container 24. As the bag 42 is filled with bulk goods 26, additional portions of stretch wrap are disposed around the bag 42. The stretch wrap is maintained at a level below the fill level of the bulk goods 26 to maintain the shape of the transportable container 24 and to squeeze the bag 42 and lock together the bulk goods 26 disposed in the bag 42. In the exemplary embodiment, the stretch wrap is an outer wrap 52 from a stretch wrap roll that is disposed spirally about the transporter base and the bag 42, but any stretch wrap known in the art, including but not limited to a stretch bag 42 and heat shrink film, may be used.

The outer wrap 52 generates hoop forces which apply a gentle squeeze to the bulk goods 26, helping to support and firm them. The hoop forces stabilize the bulk goods 26 by promoting controllable contact between the elements of the bulk goods 26 being loaded into the bag 42 of the transportable container 24, thereby promoting bridging between the components of the bulk goods 26. For example, when the bulk goods 26 being loaded are a bulk cereal in puff or flake form, hoop forces promote bridging between cereal pieces, thereby reducing the relative motion between the pieces and immobilizing the cereal within the bag 42. By adjusting the extent to which the outer wrap 52 is applied to the bag 42, hoop forces can be tailored to the type of bulk goods 26 being inserted in the transportable container 24. Hoop forces allow for a very compact and rigid transportable container 24, which does not allow the bulk goods 26 to shift or get crushed within the transportable container 24.

The transportable container 24 can be closed or left open depending on bulk goods 26. For example, certain bulk goods 26 such as wood chips, sand, gravel, and other bulk goods 26, may not require that the transportable container 24 be closed. In such instances, the outer wrap 52 would be applied around the bulk goods 26 in an upward direction to secure bulk goods 26 and create the transportable container 24. Alternatively, the transportable container 24 may be closed in any of a variety of manners known in the art including, but not limited to: sonic or heat welding of the top of the transportable container 24, closure of the top of the top of the transportable container 24 by folding over the bag 42 and securing it with at least one additional layer of outer wrap 52, closure of the top of the transportable container 24 with a plastic pull tie, closure of the top of the transportable container 24 with wire or rope, closure of the top of the transportable container 24 with a clamp, and other closure means known in the art.

The transportable container 24 may further be closed by placing a transporter base, a slip sheet, or a flat sheet of cardboard or plastic on the top of the transportable container 24. After placement of the transporter base, slip sheet or flat sheet on the top of the transportable container 24, the transportable container 24 is wrapped with additional outer wrap 52 to secure the transporter base, slip sheet or flat sheet on the top of transportable container 24.

In summary, a transportable container 24 of bulk goods 26 is formed from a gentle handling hopper 20 and scrunched or bunched bag 42. A bag 42 having an open top 56 and closed base 58 is bunched onto an intermediate carrier 54. To secure the bag 42 onto the intermediate carrier 54, the rigid intermediate carrier 54 Is placed on a feeder. The open end of the bag 42 is disposed between the plurality of feeder arms and the plurality of carrier arms 62 and each of the arm ends 64 of the plurality of carrier arms 62 are engaged with one of the plurality of feeder arms to uniformly distribute the bag 42 over each of the arm ends 64 onto each of the carrier arms 62 and secure the bag 42 on the intermediate carrier 54.

The intermediate carrier 54 is secured to the packaging system 28, with the open top 56 of the bag 42 being disposed adjacent the distributing end 92 of a hopper 20 and the closed base 58 of the bag 42 being positioned vertically below the open top 56. The distributing end 92 of the hopper 20 is placed over the bag 42 to create a vertical space between the distributing end 92 and closed base 58. The intermediate carrier 54 is secured to the upper turntable 44 of the packaging system 28 and the closed base 58 of the bag 42 is disposed in the initial former 88, which is placed onto the transportable container support 86, which is disposed on the frame base 32 of the packaging system 28. The upper and lower turntables 44, 46 rotate, preferably in synchronized rotation, to distribute the bulk goods 26 in the bag 42.

Bulk goods 26 are distributed into the hopper opening 90 of the hopper 20 to establish a hopper fill level. The bulk goods 26 are distributed from a feed source 40 into the hopper opening 90 of the hopper 20 to establish the hopper 20 fill level. The bulk goods 26 are dispensed from the distributing end 92 of the hopper 20 through the open top 56 of the bag 42 into the closed base 58 of the bag 42 to establish a level of bulk goods 26 in the bag 42. A valve operably disposed at the distributing end 92 of the hopper 20 is variably opened to dispense the bulk goods 26 through the open top 56 of the bag 42 into the closed base 58 of the bag 42 to establish the level of bulk goods 26 in the bag 42. The rate of dispensing the bulks goods from the distributing end 92 of the hopper 20 in response to the hopper fill level is adjustable based on the level of bulk goods 26 in the hopper 20 or in the transportable container 24.

The hopper 20 moves vertically during the dispensing step to maintain the vertical space between the distributing end 92 of the hopper 20 and the level of bulk goods 26 in the bag 42. The hopper fill level is maintained in the hopper 20 during the dispensing of bulk goods 26 from the hopper 20 and concurrent with the moving of the hopper 20 in response to the level of bulk goods 26 in the bag 42.

The intermediate carrier 54 moves relative to the closed base of the bag 42 to distribute the bag 42 from the intermediate carrier 54 as the level of bulk goods 26 in the bag 42 increases. In the exemplary embodiment, the intermediate carrier 54 moves upwardly relative to the stationary closed base 58 in response to the level of the bulk goods 26 in the bag 42 to distribute the bag 42 from the intermediate carrier 54 as the level of bulk goods 26 in the bag 42 increases. The outer wrap 52 is then spirally wrapped around the bag 42 in an upward direction while filling the bag 42 to form the transportable container 24.

In an alternative exemplary embodiment, the close base moves downwardly relative to the stationary intermediate carrier 54 in response to the level of the bulk goods 26 in the bag 42 to distribute the bag 42 from the intermediate carrier 54 as the level of bulk goods 26 in the bag 42 increases. The outer wrap 52 is maintained near the level of bulk goods 26 in the bag 42.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method of forming a transportable container of bulk goods from a gentle handling hopper of fixed volume with a hopper opening and a distributing end comprising the steps of:

placing the distributing end of the hopper over a bag having an open top and a closed base to create a vertical space between the distributing end and closed base;

distributing bulk goods into the hopper opening of the hopper to establish a hopper fill level;

dispensing the bulk goods from the distributing end of the hopper through the open top of the bag into the closed base of the bag to establish a level of bulk goods in the bag;

moving the hopper vertically during the dispensing step to maintain vertical space between the distributing end of the hopper and the level of bulk goods in the bag;

substantially maintaining a hopper fill level in the hopper during the dispensing step and concurrent with the moving step; and spirally wrapping an outer wrap around the bag while filling the bag to form the transportable container, the outer wrap being maintained near the level of bulk goods in the bag.

2. The method as set forth in claim 1 further comprising the steps of:

bunching a bag having an open top and closed base onto an intermediate carrier;

securing the intermediate carrier to a packaging system, the open top of the bag being disposed adjacent the distributing end of the hopper and the closed base of the bag being positioned vertically below the open top; and moving the intermediate carrier relative to the closed base of the bag to distribute the bag from the intermediate carrier as the level of bulk goods in the bag increases.

3. The method as set forth in claim 2 wherein the moving the intermediate carrier step is further defined as vertically moving the intermediate carrier upwardly relative to the stationary closed base in response to the level of the bulk goods in the bag to distribute the bag from the intermediate carrier as the level of bulk goods in the bag increases.

4. The method as set forth in claim 3 wherein the spirally wrapping step is further defined as spirally wrapping an outer wrap around the bag in an upward direction while filling the bag to form the transportable container, the outer wrap maintained near the level of bulk goods in the bag.

5. The method as set forth in claim 2 wherein the moving the intermediate carrier step is further defined as vertically moving the close base downwardly relative to the stationary intermediate carrier in response to the level of the bulk goods in the bag to distribute the bag from the intermediate carrier as the level of bulk goods in the bag increases.

6. The method as set forth in claim 2 further including the steps of:

placing an initial former onto a transportable container support being disposed on a frame base of the packaging system; and disposing the closed base of the bag into the initial former.

7. The method as set forth in claim 6 wherein the securing step is further defined as securing the intermediate carrier to an upper turntable in an upper support of the packaging system and disposing the closed base of the bag into the initial former being disposed on a lower turntable in the frame base of the packaging system.

8. The method as set forth in claim 7 further including the step of rotating the upper and lower turntables to distribute the bulk goods in the bag.

9. The method as set forth in claim 8 wherein the rotating step is further defined as synchronizing the rotation of the upper and lower turntables to distribute the bulk goods in the bag.

10. The method as set forth in claim 1 further including the step of monitoring the hopper fill level of the bulk goods disposed in the hopper with a hopper sensor.

11. The method as set forth in claim 1 further including the step of monitoring the level of the bulk goods in the bag with a fill sensor while filling the bag.

12. The method as set forth in claim 1 wherein the dispensing bulk goods step is further defined as variably opening a valve operably disposed at the distributing end of the hopper to dispense the bulk goods through the open top of the bag into the closed base of the bag to establish a level of bulk goods in the bag.

13. The method as set forth in claim 1 further including the step of adjusting the rate of dispensing the bulks goods from the distributing end of the hopper in response to the hopper fill level.

14. The method as set forth in claim 1 wherein the distributing bulk goods step is further defined as distributing bulk goods from a feed source into the hopper opening of the hopper to establish a hopper fill level.

15. The method as set forth in claim 1 wherein the spirally wrapping step is further defined as spirally wrapping an outer wrap around the bag in an upward direction while filling the bag to form the transportable container, the outer wrap maintained near the level of bulk goods in the bag.

16. The method as set forth in claim 1 further including the step of directing the flow of bulk goods from the distributing end of the hopper to desired portions of the transportable container to aid in the shaping of the transportable container.

17. A method of forming a transportable container of bulk goods with a scrunched bag system comprising the steps of:

forming an intermediate carrier having a carrier base defining a carrier opening and a plurality of carrier arms extending from the carrier base to an arm end for holding a bag having an open end and a closed base;

bunching the bag about the plurality of carrier arms to secure the bag onto the intermediate carrier;

securing the intermediate carrier to a packaging system, the open top of the bag being disposed adjacent a feed source and the closed base of the bag being positioned vertically below the open top;

feeding a plurality of bulk goods into the open top of the bag disposed on the intermediate carrier to create a level of bulk goods in the bag;

moving the intermediate carrier relative to the closed base of the bag to distribute the bag from the intermediate carrier as the level of bulk goods in the bag increases; and spirally wrapping an outer wrap around the bag while filling the bag to create the transportable container, the outer wrap being maintained near the level of bulk goods in the bag.

18. The method as set forth in claim 17 wherein the bunching a bag step further includes the steps of:

securing the intermediate carrier on a feeder having a plurality of feeder arms;

disposing the open end of the bag between the plurality of feeder arms and the plurality of carrier arms; and engaging each of the arm ends of the plurality of carrier arms with one of the plurality of feeder arms to uniformly distribute the bag over each of the arm ends onto each of the carrier arms and secure the bag on the intermediate carrier, the bag being bunched onto the intermediate carrier.

19. The method as set forth in claim 17 wherein the moving step is further defined as vertically moving the intermediate carrier upwardly relative to the stationary closed base in response to the level of the bulk goods in the bag to distribute the bag from the intermediate carrier as the level of bulk goods in the bag increases.

20. The method as set forth in claim 19 wherein the spirally wrapping step is further defined as spirally wrapping an outer wrap around the bag in an upward direction while filling the bag to form the transportable container, the outer wrap maintained near the level of bulk goods in the bag.

21. The method as set forth in claim 19 further including the step of moving the feed source vertically upward in response to the level of bulk goods in the bag.

22. The method as set forth in claim 17 wherein the moving step is further defined as vertically moving the close base downwardly relative to the stationary intermediate carrier in response to the level of the bulk goods in the bag to distribute the bag from the intermediate carrier as the level of bulk goods in the bag increases.

23. The method as set forth in claim 17 further including the step of monitoring the level of bulk goods in the bag with a fill sensor while filling the bag.

24. The method as set forth in claim 17 further including the steps of:

placing an initial former onto a transportable container support being disposed on a frame base of the packaging system; and disposing the closed base of the bag into the initial former.

25. The method as set forth in claim 24 wherein the securing step is further defined as securing the intermediate carrier to an upper turntable in an upper support of the packaging system and disposing the closed base of the bag into the initial former being disposed on a lower turntable in the frame base of the packaging system.

26. The method as set forth in claim 25 further including the step of rotating the upper and lower turntables to distribute the bulk goods in the bag.

27. The method as set forth in claim 26 wherein the rotating step is further defined as synchronizing the rotation of the upper and lower turntables to distribute the bulk goods in the bag.

28. A method of forming a transportable container of bulk goods with a scrunched bag system comprising the steps of:

securing an intermediate carrier having a carrier base defining a carrier opening and a plurality of carrier arms extending from the carrier base to an arm end-on a feeder having a plurality of feeder arms for holding a bag having an open end and a closed base;

disposing the open end of the bag between the plurality of feeder arms and the plurality of carrier arms; and engaging each of the arm ends of the plurality of carrier arms with one of the plurality of feeder arms to uniformly distribute the bag over each of the arm ends onto each of the carrier arms and secure the bag on the intermediate carrier, the bag being bunched onto the intermediate carrier securing the intermediate carrier to a packaging system, the open top of the bag being disposed adjacent a feed source and the closed base of the bag being positioned vertically below the open top;

feeding a plurality of bulk goods into the open top of the bag disposed on the intermediate carrier to create a level of bulk goods in the bag;

moving the intermediate carrier relative to the closed base of the bag to distribute the bag from the intermediate carrier as the level of bulk goods in the bag increases; and spirally wrapping an outer wrap around the bag while filling the bag to create the transportable container, the outer wrap being maintained near the level of bulk goods in the bag.

* * * * *

UNITED STATES PATENT AND TRADEMARK OFFICE

CERTIFICATE OF CORRECTION

PATENT NO. : 8,104,520 B2
APPLICATION NO. : 12/482826
DATED : January 31, 2012
INVENTOR(S) : Dave Ours et al.

It is certified that error appears in the above-identified patent and that said Letters Patent is hereby corrected as shown below:

In the Specification
Column 2, Line 61 “6-6” should read -- 7-7 --.
Column 4, Line 31 “hulk” should read -- bulk --.
Column 5, Line 62 “,” should be -- . --.
Column 11, Line 14 “Is” should be -- is --.

In the Claims
Column 14, Line 67, Claim 28 “end-on” should be -- end on --.
Column 15, Line 10, Claim 28 “carrier” should be -- carrier; --.

Signed and Sealed this
Fourth Day of February, 2014

Michelle K. Lee

Michelle K. Lee
*Deputy Director of the United States Patent and Trademark Office*